US005385760A

United States Patent [19]

Schassberger et al.

[11] Patent Number: 5,385,760

[45] Date of Patent: Jan. 31, 1995

[54] PROCESS FOR THE PRODUCTION OF A COMPOSITE COATING OF A FUNCTIONAL SUBSTANCE IN A METAL MATRIX ON THE SURFACE OF AN ARTICLE

[75] Inventors: Wolfgang Schassberger, Eisenhofen; Monika Manier, Mitterscheyern; Martin Thoma, Munich, all of Germany

[73] Assignee: MTU Motoren-und Turbinen-Union München GmbH, Munich, Germany

[21] Appl. No.: 163,473

[22] Filed: Dec. 6, 1993

[30] Foreign Application Priority Data

Dec. 9, 1992 [DE] Germany ..... 4241420

[51] Int. Cl.[6] ..... C23C 26/00

[52] U.S. Cl. ..... 427/443.1; 427/305; 427/318; 427/383.7; 205/109; 205/110; 205/143; 205/170

[58] Field of Search ..... 427/305, 443.1, 443.1 C, 427/318, 383.7; 205/110, 109, 143, 170

[56] References Cited

U.S. PATENT DOCUMENTS

| | | | |
|---|---|---|---|
| 3,644,183 | 2/1972 | Odekerken | 205/109 |
| 3,677,907 | 7/1972 | Brown | 205/109 |
| 3,723,078 | 3/1973 | Parker | 427/443.1 C |
| 3,980,549 | 9/1976 | Grutza | 205/110 |
| 4,441,965 | 4/1984 | Matsumura | 205/109 |
| 4,608,128 | 8/1986 | Farmer | 205/110 |
| 4,627,896 | 12/1986 | Nazmy | 205/109 |
| 4,659,436 | 4/1987 | Kaylor | 205/110 |
| 5,076,897 | 12/1991 | Wride et al. | 205/110 |
| 5,124,007 | 6/1992 | Tsuchiya | 205/109 |
| 5,232,744 | 8/1993 | Nakamura | 427/443.1 |
| 5,266,181 | 11/1993 | Matsumura | 205/109 |

OTHER PUBLICATIONS

F. N. Hubbell "Chemically Deposited Composites—A New Generation of Electroless Coating" Plating and Surface Finishing. Dec. 1978, pp. 58–62.

W. F. Sharp "Properties and Applications of Composite Diamond Coatings" 8th Plansee-Seminar in Reutte/-Tirol, May 30, 1974.

*Primary Examiner*—Shrive Beck
*Assistant Examiner*—Vi Duong Dang
*Attorney, Agent, or Firm*—Ladas & Parry

[57] ABSTRACT

A process for the production of structural parts or substrates with composite coatings by electrolytic or electroless deposition of a metal matrix in which the structural part or substrate surface is first coated with a mixture of a water-soluble powder of salt or acid and dispersed particles, fibers, felt, mat or woven fabric. Then the salt or the acid is melted and transformed to a water-soluble substance which fixes the particles, fibers, felt, mat or woven fabric to the surface of the structural part or substrate. The water-soluble substance is dissolved by immersing the structural part or substrate in an electrolytic or electroless deposition bath, and a metal matrix is deposited onto the structural part or substrate to incorporate the dispersed particles, fibers, felt, mat or woven fabrics in the matrix as a composite coating.

28 Claims, No Drawings

PROCESS FOR THE PRODUCTION OF A COMPOSITE COATING OF A FUNCTIONAL SUBSTANCE IN A METAL MATRIX ON THE SURFACE OF AN ARTICLE

FIELD OF THE INVENTION

The invention relates to a process for the production of a composite coating containing a functional substance on the surface of an article, such as structural parts or substrates, by means of electrolytic or electroless deposition of metals.

BACKGROUND AND CITED ART

Composite coatings with excellent technical properties are produced by inclusion of selected functional materials in an electrolytic or electroless deposited metal matrix.

The production of such composite coatings is disclosed in U.S. Pat. No. 5,076,897. The functional substances to be incorporated in the coating are introduced into an electrolyte containing the matrix material. In the subsequent electrolytic deposition of the matrix material onto the surface of a structural part or substrate, the included substances are incorporated into the matrix.

U.S. Pat. No. 5,076,897 requires the use of a complex and expensive apparatus for this purpose, since the bath containing the inclusion substances is kept continually in motion in order to avoid sedimentation effects, and the article to receive the coating is subjected to multiaxial motions in order to equalize the incorporation of the substances in the coating on the surface of the article.

Other disadvantages of the known process are that the particle size of the substance to be incorporated in the coating is limited to less than 20 μm and the amount of incorporated substance cannot exceed 25 vol. %. Due to the risk of short circuit in the electrolyte, electrically conductive substances cannot be incorporated in the matrix. Single layers, which do not contain multiple superimpositions of the substance to be incorporated, cannot be prepared with this process. In structural parts of complex shape, fluctuations in the amount of incorporated substance occur which cannot be completely compensated by motion of the structural part and the bath. The care and maintenance of the bath is difficult and expensive.

SUMMARY OF THE INVENTION

An object of the present invention is to provide a process of the above type, which does not have the noted disadvantages and is universally applicable.

Another object is to provide such a process by which one or more composite layers can be applied onto the structural part or substrate and wherein neither the form nor the size of the particles of the substance to be incorporated is restricted, so that even fibers may be incorporated in the matrix.

The above and further objects are satisfied according to the process of the invention which comprises the following steps:

a) coating the surface of an article, such as a structural part or substrate, with a mixture of a water-soluble dry powder of a salt or acid, and a functional material which is to be incorporated in the coating on the article, such as dispersed particles fibers, felt, mat, or woven fabrics;

b) melting the salt or acid in situ on the coated article to transform the salt or acid into a water-soluble substance binding the functional material to the surface of the article;

c) dissolving the water-soluble substance by immersing the coated article in an electrolytic or electroless deposition bath containing a metal matrix, and d) depositing the metal matrix on the surface of the article to incorporate the dispersed particles, fibers, felt, mat or woven fabric into the metal matrix on the surface of the article as a finished coating.

In contrast to the known art, the functional substances to be incorporated in the coating on the surface of the article are not introduced into the electrolyte, but are already attached onto the surface of the article by means of the transformation melting of the dry powder of the water-soluble salt or acid prior to the electrolytic or electroless deposition of the matrix metal. For this purpose, the reaction melting of the salt or acid onto the surface of the article takes place after the coating of the surface of the article with a mixture of the dry, water-soluble salt or acid and the dispersed particles, fibers, felt, mat or woven fabrics. The salt or acid is converted into an amorphous water-soluble substance when the coated article is immersed in the matrix metal bath. The water-soluble substance fixes the dispersed particles, fibers, felt, mat or woven fabrics onto the surface of the article and when this substance dissolves in the electrolytic or electroless deposition bath and becomes a component of the electrolyte, simultaneously the deposited matrix material fixes the substance in its position on the surface of the article and fully incorporates it into the matrix as the matrix is progressively deposited.

An advantage of this process is that the amount of the substance incorporated can be adjusted by the coating process and is independent of the capacity of the electrolyte for insoluble materials. Electrically conductive substances, such as metals may be incorporated without problems in the composite coating. In this process, single-layer composite coatings are advantageously produced, since outer layers, devoid of incorporated substance are washed away upon the dissolution of the amorphous water-soluble substance. Even the form and the size of the particles which are to be incorporated into the composite coating are not subject to limitation.

Another advantage of the process of the invention is the small contact time of the substances with the electrolytic or electroless deposition bath in comparison with the known processes, so that even ceramic and metal particles may be incorporated in the composite coating. Heretofore, this was not possible as these substances were attacked or dissolved in the electrolyte in the known process.

Mixtures of different particle sizes and materials can be realized in an advantageous way, since segregation effects do not occur. A selective localization of the substance to be incorporated can be accomplished with the process of the invention since the coating can be conducted in limited regions of the surface of the article prior to the matrix deposition. Surface regions, which are to remain completely free of coating can be covered by a mask, before the electrolytic or electroless deposition is conducted.

The process can be conducted with all electrolytes commercially available.

DESCRIPTION OF EMBODIMENTS OF THE INVENTION

In a preferred aspect of the process of the invention, the surface of the structural part or substrate is heated during or before the coating process to a temperature at which the transformation melting of the salt or of the acid into a water-soluble substance will take place. This has the advantage that melting and transformation is effected concurrently with the coating step and thus the process time can be considerably shortened. In addition, complex shapes of the surface of an article can be coated without problems, since, for example, the hot article can be immersed in the mixture of pulverized salt or acid and dispersed particles or short fibers and then it can be withdrawn from the mixture, coated over its entire extent. Hot articles with surfaces of complex shape can be advanced under a dispersing or discharging device containing the mixture for coating the entire surface of the part.

The volume ratio in the mixture of the salt or acid powder and the dispersed particles, fibers, felt, mat or woven fabrics can be adjusted in a wide range between 10:1 and 1:20. This has the advantage that the amounts incorporated can be broadly selected and the volume fraction of the substance to be incorporated can be increased to 95 vol. %. The maximum amount of incorporation is thus increased by more than three times as compared with the known process.

An average grain size of 0.5 to 100 μm in the mixture of the coating has been found suitable for the salt or acid powder. The substances to be incorporated may have an average grain size of up to 2 mm without causing difficulties in coating and incorporation. Even long fibers or continuous fibers can be introduced, preferably by winding them onto the surface of a structural part for coating the surface of the structural part with a mixture of long fibers and salt or acid powder in a composite coating. For this purpose, the pulverized salt or acid is applied to the surface of the article after the long fibers have been applied in a single or multilayer covering. The long or continuous fibers become attached by the transformation melting of the salt or acid powder and it then is incorporated into the matrix by the electrolytic or electroless deposition thereof. In the same way, the structural part or substrate surface is first coated advantageously with felt, mat, or woven fabrics, and then the water-soluble salt or acid powder is applied.

In the preparation of the mixture for the coating of the article, substances, such as felt, mat, or woven fabrics may preferably be brushed, filled, or impregnated with a solution of the salt or acid powder and water, or these substances may be immersed in such a solution. Then the water is evaporated, thereby drying the incorporated substances with adhering salt or acid solution, so that a mixture of felt, mat or woven fabrics with dried salt or acid powder is present on the surface of the structural part or substrate.

In a preferred embodiment of the process of the invention, the dispersed particles, fibers, felt, mat or woven fabrics are completely enveloped by the molten substance during reaction melting. In this way, the substances to be incorporated are advantageously protected during an intermediate storage period which enables coating a number of articles together in the electrolytic or electroless deposition bath during mass production.

According to another preferred embodiment of the invention, the dispersed particles, fibers, felt, mat or woven fabrics are attached in the transformation melting by the molten substance in such a way that their distance from the surface of the article is less than 30 μm. By virtue of this small distance, it is advantageously assured that the density of the substances to be incorporated on the surface of the structural part or substrate can be adjusted to the amount desired with a minimum of molten substance. This distance also assures an unhindered transfer of the fixation from the water-soluble substance to the fixation by the deposition process of the matrix material. The contact between the substances to be incorporated and the surface of the structural part can vary between point contact and total surface contact.

Preferably, the salt or acid powder is crystalline ortho-boric acid $H_3BO_3$, which is converted into water-soluble meta-boric acid $HBO_2$ giving off water of crystallization upon melting at a temperature of 170° C. caused by a high temperature gradient between the boric acid powder and the surface of the structural part, and then the powder is converted or transformed into a glassy fusion product with further release of water of crystallization. This glassy fusion product solidifies upon cooling into a water-soluble substance, which fixes the substance to be incorporated onto the surface of the structural part or substrate.

At a temperature of about 169° C.±1° C., the crystalline ortho-boric acid $H_3BO_3$ is transformed into crystalline meta-boric acid $HBO_2$ with release of the water of crystallization:

$$H_3BO_3+Q \rightarrow HBO_2+H_2O.$$

The crystalline meta-boric acid $HBO_2$ is converted into the glassy fusion product upon further input of heat with the release of water, which partly contains boron trioxide $B_2O_3$:

$$2HBO_2+Q \rightarrow B_2O_3+H_2O.$$

Upon cooling, the glassy fusion product solidifies into the water-soluble substance.

In the subsequent electrolytic or electroless deposition, the water-soluble substance is dissolved in the electrolyte as boric acid. This conversion and dissolution process occurs relatively slowly, so that a reliable transfer of the fixation of the substance to be incorporated from the dissolving water-soluble substance to the forming deposition matrix is assured. The boric acid which is formed has no adverse effect on the deposition process and in many cases has the effect of providing a desired buffer substance in the electrolyte.

Furthermore, water-soluble phosphates or phosphites can be used as the salt or acid powder. These have the advantage that their metal components can be correlated with the matrix material, so that they form at the same time a buffer for the substances. Thus, chromium orthophosphate $CrPO_4 \cdot 2H_2O$ can be advantageously used for a chromium matrix, and nickel hydrogen phosphite $Ni(HPO_2)_3 \cdot 6H_2O$ can be used for a nickel matrix.

Preferably Cu, Co, Ni, Cr, or alloys thereof are deposited as the matrix material. These coating materials have the advantage that they are resistant to corrosion and oxidation or are particularly suitable for anchoring particles of a hard substance as the substance to be incorporated in monolayers in the composite coating.

Preferably, the process steps are repeated in succession in order to form multiple layers of dispersed particles or short fibers in the metal matrix. This repetition has the advantage that the composition can be varied in any layer both with respect to particle size, shape, or material, as well as with respect to the amount of particles incorporated in the matrix material. Therefore, the composite coating can be made technically precise for a specific layering. In the incorporation of felt, mat or woven fabrics into a metal matrix, preferably the lowermost fiber layer of the felt, mat or woven fabric is attached by the water-soluble substance and the successive layers are applied before applying the matrix material. Thus, there is the associated advantage that relatively small quantities of salt or acid powder are required, since the remainder of the felt, mat or woven fabric can be anchored onto the surface of the structural part via the lowermost fiber layer.

Preferably, diamonds, oxides, borides, carbides, silicides, nitrides, or brittle metals or metal alloys are utilized as dispersed particles or short fibers in order to obtain an abrasive property for the composite coating. Corundum or chromium oxide are preferably used as oxides. Iron boride particles are the preferred borides. Silicon carbide particles can be employed as a hard material as a less expensive substitution for diamond particles. Titanium silicide is preferred as the silicide in the composite coatings. For nitrides, preferably cubic boron nitride is used for the particles of hard material and MCrAlY is preferably incorporated as a hard material, a brittle metal or a metal alloy.

In another preferred embodiment of the invention, the composite coating is subjected to a heat treatment after the deposition of the matrix material. This has the advantage of increased adherence, increased resistance to compression and improved diffusion bonding of the coating.

A preferred metal composite coating is obtained by first attaching dispersed particles of CoCrAlY onto the surface of a structural part by means of reaction melting and then depositing a Ni matrix. After deposition, a heat treatment step is preferably conducted, by which an extremely corrosion-resistant coating is formed with the CoNiCrAlY phase by diffusion processes between the nickel matrix and the CoCrAlY particles.

Plastics can also be preferably used as dispersed particles, fibers, felt, mat or woven fabrics. Thus, fiber-reinforced coatings or coatings having operational safety properties can be produced advantageously. Polyamide or polytetrafluoroethylene (PTFE) is preferably used as the plastic. These materials are characterized by an increased softening point in comparison with other plastics.

Particularly advantageous operational safety properties can be obtained in coatings by incorporating solid lubricants therein. For this purpose, hexagonal boron nitride or hexagonal nodular graphites are preferably mixed with the salt or acid for the coating of surfaces of structural parts, for example, for coating bearings.

In another preferred embodiment of the invention, fibers, felt, mat or woven fabrics of quartz glass, glass, carbon, or graphite are incorporated into the metal matrix. In this way, relatively inexpensive glass, carbon, or graphite-fiber reinforced metal alloy layers of increased tensile strength are produced, which are particularly advantageous for a brittle metal matrix of intermetallic phases. Preferably, for aero engines, titanium fibers are used instead of glass, carbon, or graphite fibers, and intermetallic titanium compounds are used as the matrix material, whereby hard composite coatings are formed due to the matrix and these coatings have high tensile strength due to the titanium fibers.

A preferred application of the process is the production of abrasive or abradable coatings, preferably of a nickel matrix with dispersed particles of cubic boron nitride. With such coating combinations the tips (abrasive coating) of rotor blades of equal length rub against the abradable coating on the inside of the casing and so achieve a minimum clearance. Thus, the softer nickel matrix forms an advantageous embedding medium for the hard particles of cubic boron nitride.

Another preferred application of the process is in the production of sealing coatings. In aeroengine constructions, the sealing tips of turbine blades, or labyrinth seals or coatings or shroud segments surrounding blades are preferably produced according to the process of the invention. In this way, a matrix material of copper, cobalt, nickel or alloys thereof is utilized, and aluminum oxide is incorporated as particles of hard material.

Another preferred application of the process concerns the production of abrasive layers, particularly for the production of grinding wheels. In particular, the production of diamond coated saw blades for producing cuts with widths of less than 100 μm in hard and brittle single crystals or single crystalline structural parts can be produced according to the process of the invention in an extremely precise and inexpensive manner.

DESCRIPTION OF EXAMPLES OF THE INVENTION

The following examples are representative of preferred embodiments of the process of the invention.

Example 1

A glass-fiber mat of 0.3 mm thickness comprised of glass fibers of 40 μm diameter is coated with a viscous solution, of powdered ortho-boric acid ($H_3BO_3$) and water in a volume ratio of 3:1. After evaporating the water, a mixture of pulverized water-soluble ortho-boric acid and glass-fiber mat is formed. A substrate of a sheet of iron is heated to 180° C. and coated with this mixture. At this temperature, a transformation melting of the crystalline ortho-boric acid occurs during coating with the release of water of crystallization to form meta-boric acid ($HBO_2$) or, with the further release of water of crystallization, to form a glassy fusion product on the substrate surface, due to the high temperature gradient between the substrate surface and the coating. Upon cooling, the fusion product serves to attach the glass-fiber mat onto the substrate surface.

Then the iron sheet with the attached glass-fiber mat is immersed in a nickel electrolyte bath having a pH of 3.5 to 4.5 and a composition comprising:

30 g/l $NiCl_2 \cdot 6H_2O$
30 g/l $H_3BO_3$
300 g/l nickel sulfamate
0.2–0.4 vol. % sodium-2-ethylhexylsulfonate.

A current density of 4 A per $dm^2$ is established in the electrolyte bath for 24 hours at a bath temperature of 50°–60° C.

In this way, the boric acid, which has attached the glass mat first goes into solution, and the attachment is taken over by the depositing nickel, until the glass-fiber mat is completely incorporated in a nickel matrix.

The adherence of the composite layer on the sheet iron substrate can be increased by a heat treatment step at 150°-500° C. for 1-10 hours.

Example 2

A metal powder of CoCrAlY with an average grain size of 100 μm is mixed with ortho-boric acid powder of an average grain size of 30 μm in a volume ratio of 3:1. The surface of a turbine blade made of a Ni base alloy is coated with this mixture at 180°-190° C. In this way, a transformation melting of the crystalline ortho-boric acid takes place, so that the ortho-boric acid is converted to meta-boric acid with the release of water of crystallization and then to a glassy fusion state with the further release of water of crystallization. Upon cooling of the melt, the CoCrAlY particles are attached onto the blade surface.

The cooled blade is immersed in a nickel bath for electroless deposition of nickel, the bath being at a pH of 4.5-4.8 and having the following composition:

20-40 g/l nickel chloride
5-15 g/l solution hypophosphite
2-10 g/l sodium glycolate.

The boric acid goes into solution and the outermost particles are washed off until there is a monolayer remaining on the blade surface. The attachment in the monolayer of CoCrAlY particles due to the solidified boric acid product is taken over by the fixation of the depositing nickel. The CoCrAlY particles near the surface of the blade are completely incorporated in a Ni matrix to form a monolayer within 10 hours at a bath temperature of 50°-60° C.

This composite coating is then heat treated at 1000°-1150° C. for 5 hours. In this way, a corrosion-resistant coating with a high density CoNiCrAlY phase is formed.

Example 3

A compressor blade made of a titanium alloy is completely covered with a mask except for the front surface of the blade tip. For the production of an abrasive blade tip coating, the blade is heated to 180°-200° C. and coated with a mixture of ortho-boric acid powder of an average grain size of 30 μm and cubic boron nitride particles of an average grain size of 250 μm. A transformation melting takes place on the surface of the hot blade so that upon cooling, a monolayer of boron nitride particles is fixed to the blade tip by the resulting glassy fusion product.

The blade is then immersed in an electrolytic nickel bath having the following composition:

300 g/l nickel sulfate
40 g/l ortho-boric acid
4 ml/l sodium-2-ethylhexyl sulfonate.

The bath is subjected to a current density of 4 A per $dm^2$ at a bath temperature of 50° C., which causes the solidified glassy fusion product to go into solution while a nickel matrix is deposited over a period of 6 hours, whereby at least two-thirds of the length of the boron nitride particles are incorporated into the nickel matrix.

If the boron nitride particles are incorporated into a nickel matrix only up to two-thirds of their length, they then form a tooth-type abrasive lining at the blade tip. A protective coating, for example, a thermoplastic material or a wax is then removed from the surface regions of the blade covered by the mask.

Example 4

A contacting segment of a cylindrical jacket of a drive mechanism is coated with a mixture of pulverized phosphite and graphite particles (nodular graphite, diameter 80 μm). After heating the contacting segment to 180°-200° C., the graphite particles become attached to the surface of the contacting segment by the water-soluble substance which is formed by the phosphite.

After immersion for 5 hours in a lead/indium electrolyte subjected to a current density of 4 A per $dm^2$, the graphite particles are incorporated as a monolayer in a lead/indium matrix. After drying the thus formed composite monolayer coating, the coated structural part is again coated, and a second monolayer of nodular graphite of a diameter of 40 μm is embedded electrolytically in a lead/indium matrix. Thereafter, a third monolayer is produced with a nodular graphite diameter of only 20 μm.

Extremely complex composite coatings can be realized with the process of the invention, which may be adapted exactly to the technical requirements.

Although the invention has been described with reference to specific embodiments and examples thereof, it will become apparent to those skilled in the art that numerous modifications and variations can be made without departing from the scope and spirit of the invention as defined in the attached claims.

What is claimed is:

1. A process of applying a composite coating on the surface of an article comprising the steps of:

covering a surface of an article with a dispersed mixture comprising a water-soluble powder of an acid or salt and a functional material, melting the water-soluble acid or salt in situ on the covered metal article to transform the acid or salt to a water soluble product which adheres to the surface of the article and fixes the functional material thereto, and immersing the thus coated article into an electrolytic or electroless bath containing a metal matrix and effecting electrolytic or electroless deposition of said matrix onto the surface of the article coated with said functional material while dissolving said water-soluble product in the bath to incorporate said functional material into said matrix and fix said functional material to the surface of the article by said matrix in replacement of the now dissolved water soluble product of said acid or salt.

2. A process as claimed in claim 1, wherein said functional material is selected from the group consisting of dispersed particles, fibers, felt, mat and woven fabrics.

3. A process as claimed in claim 1, comprising effecting said melting of the water-soluble acid or salt by heating the article.

4. A process as claimed in claim 3, comprising effecting said heating of the article prior to covering the article.

5. A process as claimed in claim 3, comprising effecting said heating of the article after covering the article.

6. A process as claimed in claim 3, wherein the acid or salt comprises a dry powder present in a volume ratio of between 10:1 and 1:20 relative to said functional material.

7. A process as claimed in claim 3, comprising effecting said heating of the article to a temperature at which the acid or salt is transformed into a fusion product of the water-soluble acid or salt to fix said functional material onto the surface of the article.

8. A process as claimed in claim 7, comprising enveloping said functional material into said fusion product.

9. A process as claimed in claim 7, comprising effecting the fixing of the functional material onto the surface of the article at a distance from said surface of the article of less than 30 μm.

10. A process as claimed in claim 1, wherein said acid or salt comprises crystalline boric acid.

11. A process as claimed in claim 1, wherein said acid or salt comprises water soluble phosphates or phosphites.

12. A process as claimed in claim 1, wherein the metal matrix in said bath is Cu, Co, Ni, Cr or alloys thereof.

13. A process as claimed in claim 1, comprising successively repeating the steps of coating, melting, immersing and electrolytic or electroless deposition to form a plurality of layers of said functional material and said metal matrix on the surface of said article.

14. A process as claimed in claim 1, wherein said coating of the surface of the article is effected first by applying said functional material to the surface of the article and then by applying the water-soluble acid or salt thereon.

15. A process as claimed in claim 1, comprising producing said mixture of water-soluble acid or salt and said functional material by impregnating said functional material with a solution of said acid or salt and thereafter drying the acid or salt.

16. A process as claimed in claim 15, comprising effecting said impregnating of the material with the solution of acid or salt by immersing the material in said solution.

17. A process as claimed in claim 1, wherein said functional material is selected from the group consisting of diamonds, oxides, borides, carbides, silicides, nitrides, and brittle metals or metal alloys.

18. A process as claimed in claim 1, comprising heat treating the article after the coating thereof with said functional material and said metal matrix.

19. A process as claimed in claim 1, wherein said functional material coating the surface of the article comprises a plastic material.

20. A process as claimed in claim 19, wherein said plastic material is a polyamide or PTFE.

21. A process as claimed in claim 1, comprising adding a lubricant to said mixture of acid or salt and said functional material.

22. A process as claimed in claim 1, wherein said functional material is selected from the group consisting of quartz glass, glass, carbon and graphite.

23. A process as claimed in claim 1, wherein said metal matrix comprises titanium fibers.

24. A process as claimed in claim 23, wherein said metal matrix comprises intermetallic compounds.

25. A process as claimed in claim 1, wherein said metal matrix comprises a nickel matrix containing dispersed particles of cubic boron nitride.

26. A process as claimed in claim 1, wherein the coated article comprises a sealing system for turbine blade tips or turbine blades.

27. A process as claimed in claim 1, wherein the coating on said article is an abrasive coating and said article comprises a grinding wheel.

28. A process as claimed in claim 1, wherein said functional material which is coated on the article comprises a fiber and the metal matrix comprises a metal alloy whereby the surface of the article is coated by a fiber-reinforced metal alloy.

* * * * *